US009359805B2

(12) United States Patent
Tan et al.

(10) Patent No.: US 9,359,805 B2
(45) Date of Patent: Jun. 7, 2016

(54) SECURITY SAFE AND SELF-SERVICE TERMINAL PROVIDED WITH SAME

(75) Inventors: Yongan Tan, Guangzhou (CN); Pengying Xu, Guangzhou (CN); Yuxuan Xie, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 20 days.

(21) Appl. No.: 13/811,201

(22) PCT Filed: Oct. 25, 2011

(86) PCT No.: PCT/CN2011/081231

§ 371 (c)(1), (2), (4) Date: Jan. 18, 2013

(87) PCT Pub. No.: WO2012/100569

PCT Pub. Date: Aug. 2, 2012

(65) Prior Publication Data

US 2013/0298808 A1 Nov. 14, 2013

(30) Foreign Application Priority Data

Jan. 25, 2011 (CN) ..... 2011 1 0027417

(51) Int. Cl.
*E05G 1/04* (2006.01)
*E05G 1/026* (2006.01)
(Continued)

(52) U.S. Cl.
CPC ..... *E05G 1/04* (2013.01); *E05B 65/0082* (2013.01); *E05G 1/026* (2013.01); *E05B 17/2038* (2013.01); *E05B 47/0002* (2013.01); *E05B 65/0075* (2013.01)

(58) Field of Classification Search
CPC ..... E05B 65/0075; E05B 65/0082; E05B 17/2038; E05B 47/002; E05B 17/04; E05B 17/2092; E05G 1/04; E05G 1/026
USPC ..... 70/1.5, 118–120; 109/59 R, 62, 59 T, 109/63.5, 61, 63
See application file for complete search history.

(56) References Cited

U.S. PATENT DOCUMENTS 18,157 A * 9/1857 Perry ..... 70/1.5
3,597,949 A * 8/1971 Nigrelli ..... 70/490
(Continued)

FOREIGN PATENT DOCUMENTS

AU 424812 B2 3/1971
CN 2319541 Y 5/1999
(Continued)

OTHER PUBLICATIONS

Supplementary European Search Report dated Nov. 27, 2013, from corresponding European Application 11856678.
(Continued)

*Primary Examiner* — Suzanne Barrett
*Assistant Examiner* — Morgan McClure
(74) *Attorney, Agent, or Firm* — Wolf, Greenfield & Sacks, P.C.

(57) ABSTRACT

Disclosed are a security safe (1) and a self-service terminal provided with the security safe (1), wherein the security safe comprises a safe body (10) with a safe door (11) on at least one side thereof, the safe door (11) is provided with a safe door locking engagement system (12), and the safe door locking engagement system (12) comprises a movable latch (121) for achieving the locking engagement between the safe door (11) and the safe body (10). The locking engagement system (12) also comprises a brittle part fixedly provided on the inner side of the safe door (11), the brittle part controls at least one safe pin (123), and when the brittle part is broken the safe pin (123) keeps the movable latch (121) locked. The security safe (1) can solve the problem that there are weak areas in existing safes, and it has low cost and high reliability.

5 Claims, 5 Drawing Sheets

(51) Int. Cl.

| | |
|---|---|
| *E05B 47/00* | (2006.01) |
| *E05B 17/20* | (2006.01) |
| *E05B 65/00* | (2006.01) |

(56) References Cited

U.S. PATENT DOCUMENTS

| | | | | | |
|---|---|---|---|---|---|
| 4,037,440 | A | * | 7/1977 | Shabtai et al. | 70/108 |
| 4,074,547 | A | * | 2/1978 | Seidewand | 70/1.5 |
| 4,074,548 | A | * | 2/1978 | Milton | 70/1.5 |
| 4,307,589 | A | * | 12/1981 | Kajita | 70/276 |
| 4,318,354 | A | * | 3/1982 | Fish | 109/59 R |
| 4,397,165 | A | * | 8/1983 | LiCausi | 70/1.5 |
| 4,413,493 | A | * | 11/1983 | Meinsen et al. | 70/422 |
| 4,470,275 | A | * | 9/1984 | Fisher | 70/1.5 |
| 4,493,199 | A | * | 1/1985 | Uyeda | 70/333 R |
| 4,520,736 | A | * | 6/1985 | Crosby et al. | 109/60 |
| 4,648,255 | A | * | 3/1987 | Gartner | 70/417 |
| 4,669,287 | A | * | 6/1987 | Reader et al. | 70/360 |
| 4,679,415 | A | * | 7/1987 | Spratt | 70/118 |
| 4,850,287 | A | * | 7/1989 | Lichter | 109/59 R |
| 4,852,503 | A | * | 8/1989 | Lichter | 109/59 R |
| 4,926,762 | A | * | 5/1990 | Paul | 109/51 |
| H904 | H | * | 4/1991 | Schmidlin | 206/3 |
| 5,060,583 | A | * | 10/1991 | Stinson | 109/50 |
| 5,245,846 | A | * | 9/1993 | James | 70/118 |
| 5,249,831 | A | * | 10/1993 | Maniaci | 292/144 |
| 6,082,153 | A | * | 7/2000 | Schoell et al. | 70/1.5 |
| 6,098,433 | A | * | 8/2000 | Maniaci | 70/278.1 |
| 2007/0261615 | A1 | * | 11/2007 | Evans et al. | 109/59 R |
| 2008/0092606 | A1 | * | 4/2008 | Meekma | 70/120 |
| 2011/0289985 | A1 | * | 12/2011 | MacKay et al. | 70/1.5 |
| 2014/0182489 | A1 | * | 7/2014 | Suggs et al. | 109/59 R |

FOREIGN PATENT DOCUMENTS

| | | | |
|---|---|---|---|
| CN | 201265290 | Y | 7/2009 |
| CN | 201486394 | U | 5/2010 |
| CN | 201883891 | U | 6/2011 |
| CN | 102128001 | A | 7/2011 |
| DE | 9204933 | U1 | 6/1992 |
| DE | 10014797 | C1 | 5/2001 |
| EP | 0087225 | A1 | 8/1983 |
| EP | 0571011 | A2 | 11/1993 |
| EP | 1396601 | A | 3/2004 |
| ES | 519676 | A | 2/1983 |
| GB | 04571 | A | 0/1914 |
| GB | 1012115 | A | 12/1965 |
| GB | 2146689 | A | 4/1985 |
| GB | 2172931 | A | 10/1986 |
| GB | 2249126 | A | 4/1992 |
| JP | 2001336322 | A | 12/2001 |
| JP | 2006207315 | A | 8/2006 |

OTHER PUBLICATIONS

International Search Report dated Dec. 30, 2011 from corresponding International Application No. PCT/CN2011/081231.

Chilean Office Action dated Dec. 3, 2014 from corresponding Chilean Application 2078-13.

* cited by examiner

SECURITY SAFE AND SELF-SERVICE TERMINAL PROVIDED WITH SAME

The present application is the U.S. National Phase of International Application No. PCT/CN2011/081231 titled "SECURITY SAFE AND SELF-SERVICE TERMINAL PROVIDED WITH SAME", filed on Oct. 25, 2011, which claims the benefit of priority to Chinese patent application No. 201110027417.3 titled "SAFE COFFER AND SELF-SERVICE TERMINAL WITH THE SAME", filed with Chinese State Intellectual Property Office on Jan. 25, 2011, the entire disclosures of which are incorporated herein by reference.

FIELD OF THE INVENTION

The present application relates to a field of safety device for a bank, in particular to a safe coffer device which can avoid being opened violently.

BACKGROUND OF THE INVENTION

Under present technology conditions, a coffer body of a coffer is made from multiple layers of steel plates, which kind of coffer has strong anti-attack ability. However, some regions of the door on which a dial of a combination lock, a cover of the combination lock and a handle are mounted are relatively weak, and are likely to be attacked by criminals. Generally, the criminals may violently attack the coffer from above mentioned weak regions toward inside of the coffer, so as to destroy combination lock mounted on the back side of the door, or the criminals may drill a hole in the door to destroy a position-limiting bolt of the combination lock, or the criminals may drill a hole to the combination lock and apply an inward force through the hole to destroy the combination lock. The above mentioned regions that may be attacked are referred to as "weak regions" of the coffer, and it is easy for a criminal to successfully open the door of the coffer if he/she attacks the coffer from one of the above mentioned "weak regions".

SUMMARY OF THE INVENTION

In view of the "weak regions" of the prior coffer, it is provided according to the present application a safe coffer which can effectively avoid being violently and illegally opened from above mentioned "weak regions".

The safe coffer provided according to the present application includes a coffer body, at least one side of the coffer body is provided with a door. The door is provided with a door locking system, and the door locking system includes a movable bolt which can keep the door and the coffer body in a locking state. The door locking system further includes a breakable component which is fixedly provided on an inner side of the door and can control at least one safety pin. The safety pin can keep the movable bolt in the locking state when the breakable component is broken.

Preferably, the safety pin is pulled by and connected to the breakable component via a to linear traction component. When the breakable component is broken, the breakable component cannot apply any traction force to the linear traction component, and thus the safety pin can protrude out to keep the movable bolt in the locking state.

Further, the safety pin includes: a fixing bracket which is a hollow element and is fixedly mounted on an inner side of the door, a pin member mounted in a cavity of the fixing bracket, and an elastic member provided in a compressed state between the pin member and an inner wall of the cavity of the fixing bracket. An end of the pin member adjacent to a bottom portion of the cavity is pulled by the linear traction component.

Preferably, the door locking system further includes a slidable plate which is connected with the movable bolt and can be controlled to slide leftwards or rightwards by an operation component provided outside the coffer. The leftward or rightward sliding of the slidable plate brings the movable bolt to lock or unlock the door and the coffer body. The slidable plate is provided at a side thereof with a groove. The groove corresponds to the safety pin when the movable bolt is in the locking state.

Further, the door locking system further includes a combination lock. The safety pin includes a self-locking pin, a pin bracket which can fix the self-locking pin on the inner side of the door, and an elastic member, elasticity of which is towards the groove, provided in a compressed state between the self-locking pin and the pin bracket. The self-locking pin is provided thereon with a position-limiting pole for stopping the elastic member, and the position-limiting pole is limited by a self-locking pin fixing plate fixedly provided at a back portion of the combination lock. The self-locking pin fixing plate is provided therein with a position-limiting pole hole which corresponds to self-locking pin. When the self-locking pin fixing plate is moved towards an inner side of the coffer, the position-limiting pole can move out of the position-limiting pole hole in the self-locking pin fixing plate, and thus the self-locking pin can enter the corresponding groove in the side of the slidable plate to keep the movable bolt in the locking state.

Further, at least one edge of the self-locking pin fixing plate is formed into a bend edge which is bent towards the breakable component and hooks on the breakable component.

Preferably, the safety pin includes a self-locking pin, a pin bracket which can fix the to self-locking pin on the inner side of the door, and an elastic member, elasticity of which is towards the groove, provided in a compressed state between the self-locking pin and the pin bracket. The self-locking pin is provided thereon with a position-limiting pole for stopping the elastic member, and an end of the self-locking pin away from the position-limiting pole is hung on the breakable component via a retaining bracket. When the breakable component is broken, the retaining bracket falls off, thus the self-locking pin enters the corresponding groove in the side of the slidable plate to keep the movable bolt in the locking state.

Preferably, the breakable component is a tempered glass plate fixedly provided on the inner side of the door.

Further, the door is further fixedly provided on the inner side thereof with a component fixing plate, and the tempered glass plate is provided between the door of the coffer and the component fixing plate.

In addition, it is further provided according to the present application a self-service terminal provided with the safe coffer mentioned above.

Compared with the prior art, the present application has the following advantageous effects:

1. the safe coffer according to the present application can effectively prevent the coffer from being attacked from the combination lock;

2. the safe coffer according to the present application can effectively prevent the coffer from being attacked by drilling from the door to the inner side of the coffer, and can enhance safety of the coffer.

DETAILED DESCRIPTION

Hereinafter, a safe coffer which can effectively avoid being violently and illegally opened from above mentioned "weak regions" according to the present application will be described in detail in conjunction with the figures.

Figure 1:
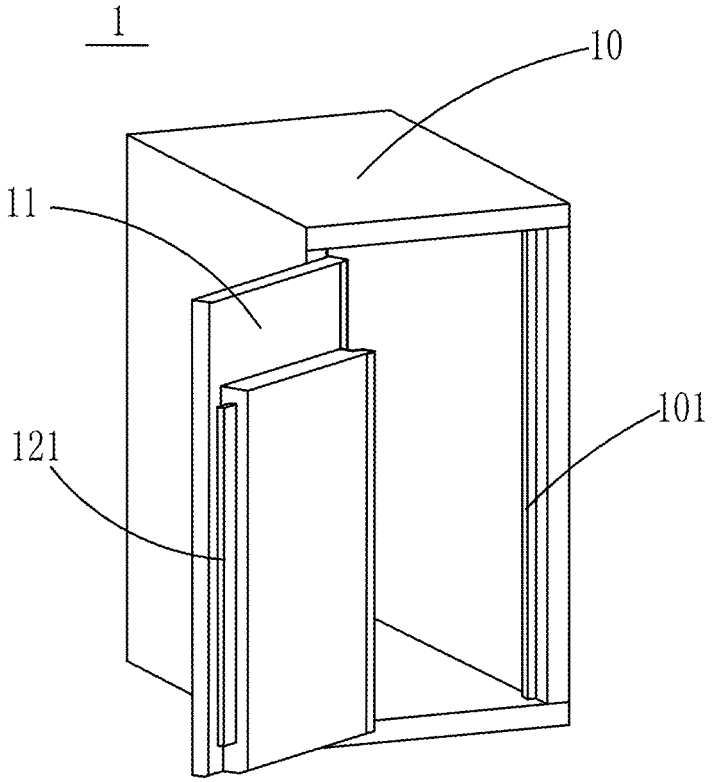
FIG. 1 is a using state view of a safe coffer according to an embodiment of the present application.
Figure 2:
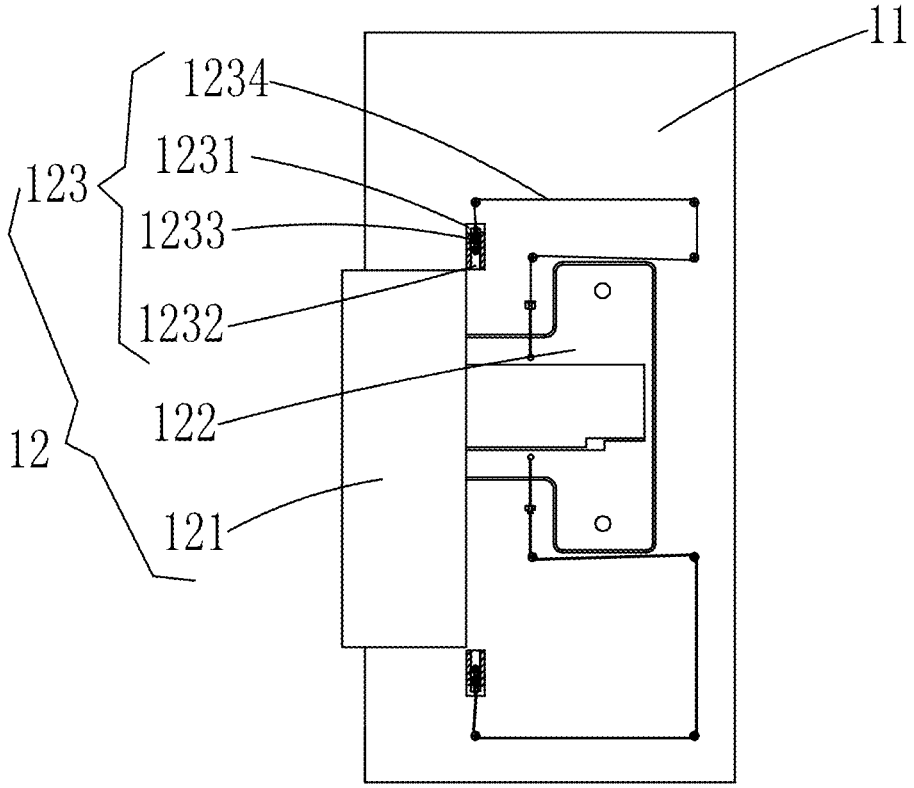
FIG. 2 is an internal structure view of a safe coffer according to the embodiment of the present application.

Referring to FIGS. 1 and 2, FIG. 1 is a using state view of a coffer door safety device according to the present application. The safe coffer 1 includes a coffer body 10 provided at a side thereof with a door 11. The door 11 is pivotally connected at an edge thereof to an edge of the coffer body, and is provided with a door locking system 12. The door locking system 12 includes a movable bolt 121 which can keep the door 11 and the coffer body 10 in a locking state. The door locking system 12 further includes a tempered glass plate 122 which is fixedly provided on an inner side of the door 11. The tempered glass plate 122 controls a safety pin 123 which can keep the bolt 121 in a locking state if the tempered glass plate 122 is broken. The tempered glass plate 122 provided according to the present embodiment may also employ other available materials which have a certain rigidity and is easily to be broken when suffering from violent attack, for example, ceramic and other brittle materials.

The movable bolt 121 is mounted on the inner side of the door 11 and can protrude in a direction away from a pivot of the door. The coffer body 10 is provided at a position of an inner wall thereof corresponding to the movable bolt 121 with a position-limiting bar 101. When the coffer 1 is locked, the coffer body 10 is engaged with the door 11, and the movable bolt 121 can be inserted inside the position-limiting bar 101. At this time, the door 11 cannot be opened because of a limitation action of the position-limiting bar 101.

Figure 3:
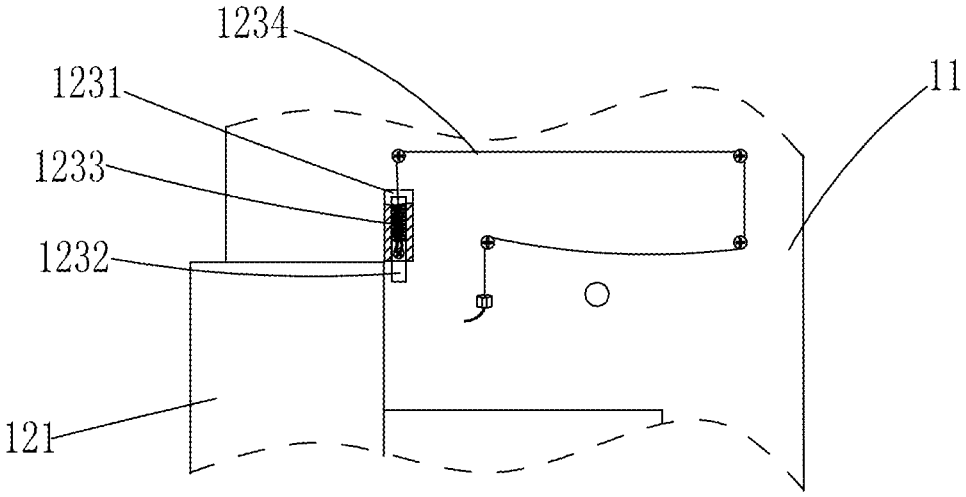
FIG. 3 is a schematic view of a safety pin of the safe coffer shown in FIG. 2 after to being violently attacked.

In particular, referring to FIG. 2, FIG. 2 further illustrates the safety pin component in the door locking system 12. The safety pin 123 includes: a fixing bracket 1231 which is a hollow element and is fixedly mounted on the inner side of the door 11, and a pin member 1232 which is mounted in a cavity of the fixing bracket. A telescopic spring 1233 is provided in a compressed state between the pin member 1232 and an inner wall of the cavity of the fixing bracket 1231. An end of the pin member 1232 adjacent to a bottom portion of the cavity is pulled by and connected to the tempered glass plate 122 via a wire rope 1234. The pin member 1232 can compress the spring 1233 and retract into the cavity of the fixing bracket 1231 under a traction force of the wire rope 1234. Referring to FIG. 3, if the tempered glass plate 122 is broken, no traction force is applied to the wire rope 1234, and thus the wire rope 1234 cannot apply any traction force to the pin member 1232. In this case, the pin member 1232 can protrude out of the cavity of the fixing bracket 1231 under a restoring force of the spring 1233. Since the protruded pin member 1232 is located in the opening path of the movable bolt 121, the protruded pin member 1232 can effectively keep the movable bolt 121 in the locking state.

It is to be noted that, in order that the coffer is more safe and reliable, the door locking system 12 may be provided with a plurality of groups of safety pins 123. As shown in FIG. 2, the door locking system 12 may be provided at an upper portion and at a lower portion thereof respectively with one safety pin, such that the movable bolt 121 can be blocked uniformly.

Figure 4:
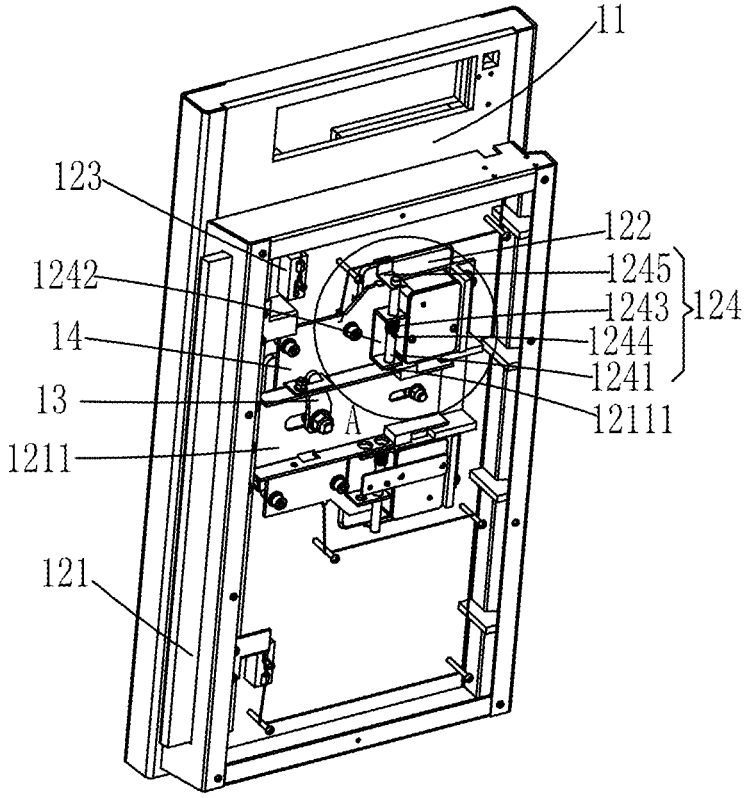
FIG. 4 is an internal structure schematic view of a door of a safe coffer according to another embodiment of the present application.

Referring to FIGS. 1 and 4, FIG. 4 shows a safe coffer according to another embodiment of the present application. In the safe coffer, the door locking system 12 includes a movable bolt 121 which can keep the door 11 and the coffer body 10 in a locking state. The movable bolt 121 is connected with a slidable plate 1211. The slidable plate 1211 can be controlled to slide leftwards or rightwards through a small bolt 13 operated by an operation component (not shown in the figure) provided outside the coffer. The leftward or rightward sliding of the slidable plate 1211 may bring the movable bolt 121 to lock or unlock the door 11 and the coffer body 10. The slidable plate 1211 is provided at a side thereof with a groove 12111 which corresponds to the position of a safety pin 124 when the movable bolt 121 is in a locking state. The door locking system 12 further includes a tempered glass plate 122 fixedly provided on the inner side of the door 11. The tempered glass plate 122 can control two safety pins 123 and 124. If the tempered glass plate 122 is broken, safety pins 123 and 124 can keep the movable bolt 121 in the locking state. The tempered glass plate 122 provided according to the present embodiment may also employ other available materials which have a certain rigidity and is easily to be broken when suffering from violent attack, for example, ceramic and other brittle materials. In order to facilitate mounting of the slidable plate 1211 and other components that need to be fixed with respect to the door 11, the tempered glass plate 122 is additionally provided at a side thereof away from the door 11 with a mounting plate 14. The slidable plate 1211 is movably connected with the mounting plate 14, and the safety pin 124 is fixedly mounted on the mounting plate 14.

The movable bolt 121 is mounted on the inner side of the door 11 and can be brought by the slidable plate 1211 to protrude in a direction away from the pivot of the door. The coffer body 10 is provided at a position of the inner wall thereof corresponding to the movable bolt 121 with a position-limiting bar 101. When the coffer 1 is locked, the coffer body 10 is engaged with the door 11, and the movable bolt 121 can be inserted inside the position-limiting bar 101. In this case, the door 11 cannot be opened because of a limitation action of the position-limiting bar 101.

In particular, reference may be made to FIG. 2. The safety pin 123 of the door locking system 12 includes: a fixing bracket 1231 which is a hollow element and is fixedly mounted on the inner side of the door 11, and a pin member 1232 which is mounted in a cavity of the fixing bracket 1231. A telescopic spring 1233 is provided in a compressed state between the pin member 1232 and an inner wall of the cavity of the fixing bracket 1231. An end of the pin member 1232 adjacent to a bottom portion of the cavity is pulled by and connected to the tempered glass plate 122 via a wire rope 1234. The pin member 1232 can compress the spring 1233 and retract into the cavity of the fixing bracket 1231 under a traction force of the wire rope 1234. If the tempered glass plate 122 is broken, no traction force is applied to the wire rope 1234, and thus the wire rope 1234 cannot apply any traction force to the pin member 1232. In this case, the pin member 1232 can protrude out of the cavity of the fixing bracket 1231 under a restoring force of the spring 1233. Since the protruded pin member 1232 is located in the opening path of the movable bolt 121, the protruded pin member 1232 can effectively keep the movable bolt 121 in the locking state.

Figure 5:
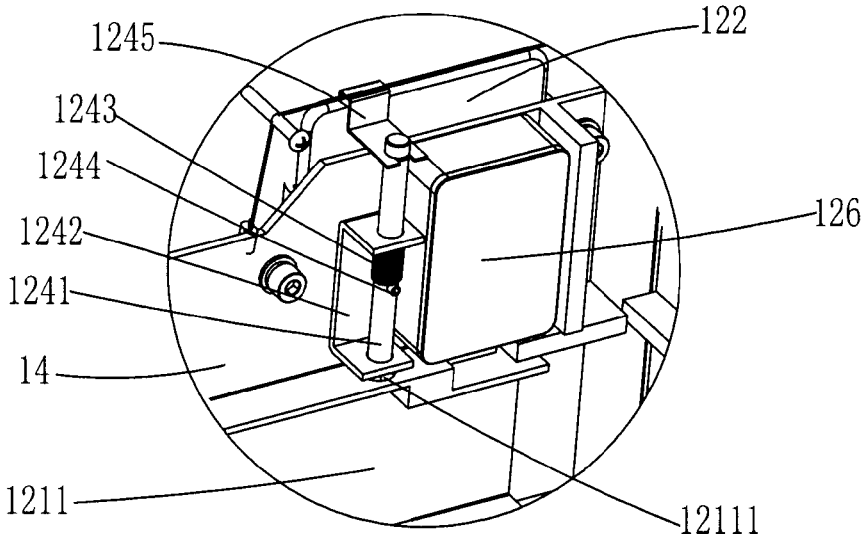
FIG. 5 is a partial enlarged view of part A in FIG. 4.

Referring to FIG. 5, the safety pin 124 of the door locking system 12 includes a self-locking pin 1241 and a pin bracket 1242 which can fix the self-locking pin 1241 on an inner side of the mounting plate 14. A spring 1243 is provided in a compressed state between the self-locking pin 1241 and the pin bracket 1242, and the self-locking pin 1241 is provided thereon with a position-limiting pole 1244 for stopping the spring 1243. An end of the self-locking pin 1241 away from the position-limiting pole 1244 is hung on the tempered glass plate 122 via a retaining bracket 1245. If the tempered glass plate 122 is broken, the tempered glass plate 122 cannot support the retaining bracket 1245 anymore, and thus the retaining bracket 1245 cannot apply any traction force to the self-locking pin 1241. In this case, the self-locking pin 1241 can protrude out of the pin bracket under a restoring force of the spring 1243. The protruded self-locking pin 1241 can enter corresponding groove 12111 in the slidable plate 1211 and thus can effectively keep the movable bolt 121 in the locking state.

Figure 6:
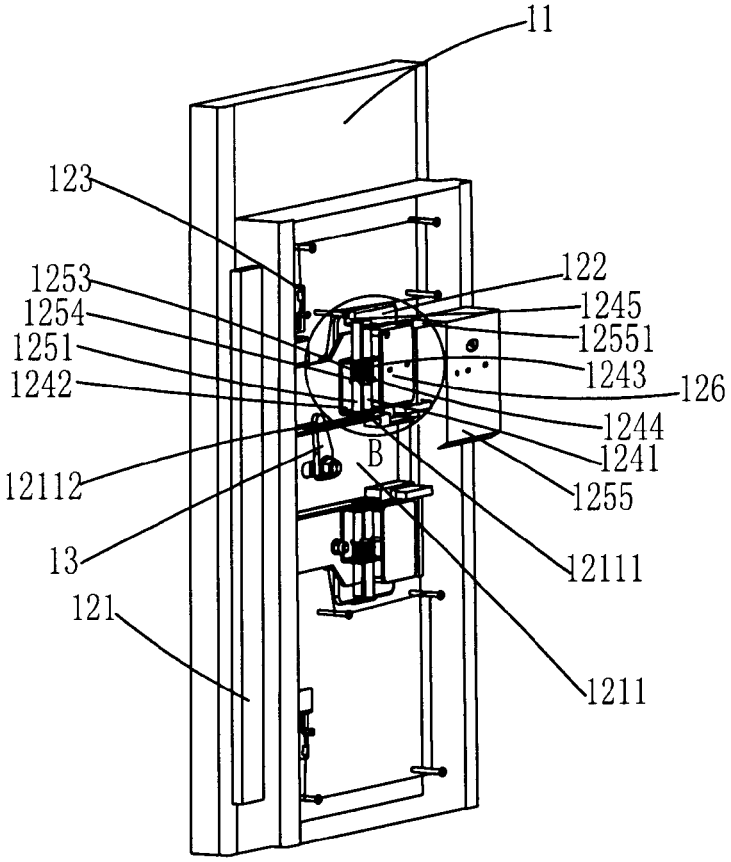
FIG. 6 is an internal structure schematic view of a safe coffer according to a third embodiment of the present application.
Figure 7:
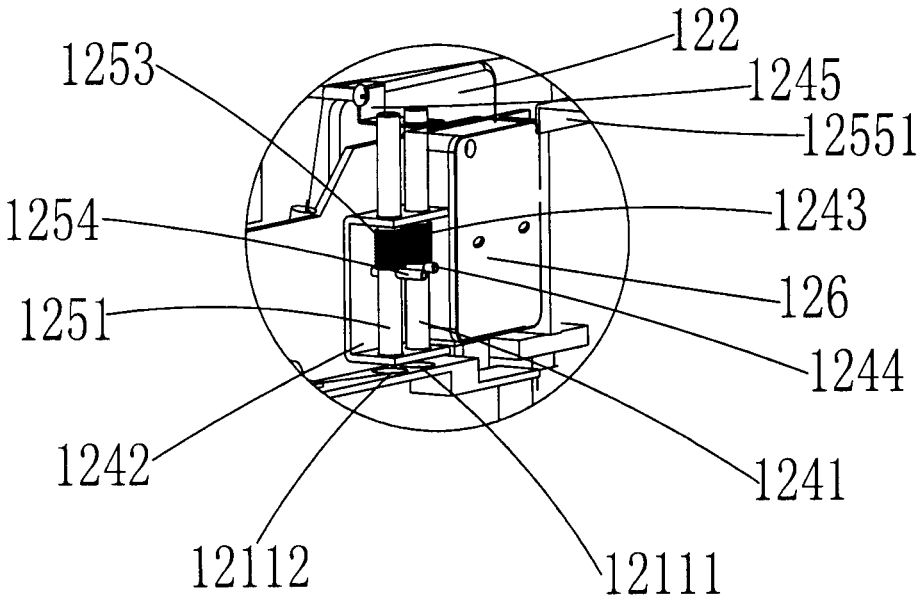
FIG. 7 is a partial enlarged view of part B in FIG. 6.
Figure 8:
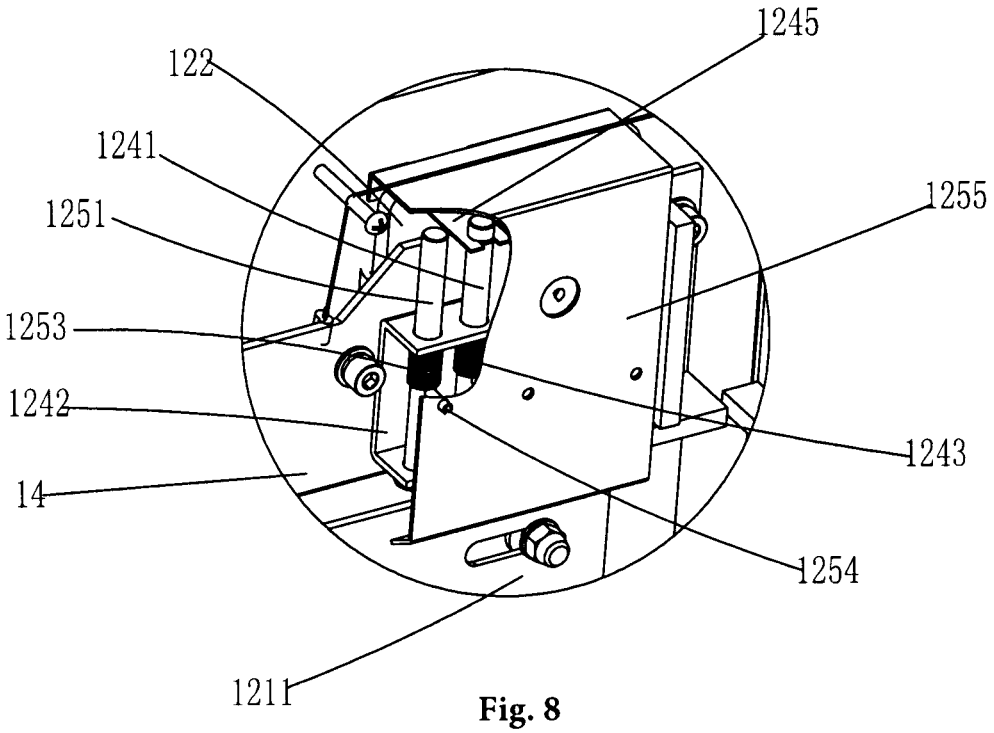
FIG. 8 is a partial sectional view of a safety pin of the safe coffer according to the third embodiment of the present application.

Referring to FIGS. 6, 7 and 8, FIGS. 6, 7 and 8 are inner structure schematic views of a door of a safe coffer according to a third embodiment of the present application. In the coffer, the door locking system 12 includes a movable bolt 121 which can keep the door 11 and the coffer body 10 in a locking state. The movable bolt 121 is connected with a slidable plate 1211. The slidable plate 1211 can be controlled to slide leftwards or rightwards through a small bolt 13 operated by an operation component (not shown in the figure) provided outside the coffer. The leftward or rightward sliding of the slidable plate 1211 may bring the movable bolt 121 to lock or unlock the door 11 and the coffer body 10. The slidable plate 1211 is provided at a side thereof with grooves 12111 and 12112 in which the safety pins 123 and 124 to are disposed when the movable bolt 121 is in a locking state. The door locking system 12 further includes a tempered glass plate 122 fixedly provided on the inner side of the door 11. The tempered glass plate 122 can control two safety pins 123 and 124. When the tempered glass plate 122 is broken, the safety pins 123 and 124 can keep the movable bolt 121 in the locking state. The tempered glass plate 122 provided according to the present embodiment may also employ other available materials which have a certain rigidity and is easily to be broken when suffering from violent attack, for example, ceramic and other brittle materials. In order to facilitate mounting of the slidable plate 1211 and other components that need to be fixed with respect to the door 11, the tempered glass plate 122 is additionally provided at a side thereof away from the door 11 with a mounting plate 14. The slidable plate 1211 is movably connected with the mounting plate 14, and the safety pin 124 is fixedly mounted on the mounting plate 14.

The movable bolt 121 is mounted on the inner side of the door 11 and can be brought by the slidable plate 1211 to protrude in a direction away from the pivot of the door. The coffer body 10 is provided at a position of the inner wall thereof corresponding to the movable bolt 121 with a position-limiting bar 101. When the coffer 1 is locked, the coffer body 10 is engaged with the door 11, and the movable bolt 121 can be inserted inside the position-limiting bar 101. In this case, the door 11 cannot be opened because of a limitation action of the position-limiting bar 101.

In particular, reference may be made to FIG. 2. The safety pin 123 of the door locking system 12 includes: a fixing bracket 1231 which is a hollow element and is fixedly mounted on the inner side of the door 11, and a pin member 1232 which is mounted in a cavity of the fixing bracket 1231. A telescopic spring 1233 is provided in a compressed state between the pin member 1232 and an inner wall of the cavity of the fixing bracket 1231. An end of the pin member 1232 adjacent to a bottom portion of the cavity is pulled by and connected to the tempered glass plate 122 via a wire rope 1234. The pin member 1232 can compress the spring 1233 and retract into the cavity of the fixing bracket 1231 under a traction force of the wire rope 1234. If the tempered glass plate 122 is broken, no traction force is applied to the wire rope 1234, and thus the wire rope 1234 cannot apply any traction force to to the pin member 1232. In this case, the pin member 1232 can protrude out of the cavity of the fixing bracket 1231 under a restoring force of the spring 1233. Since the protruded pin member 1232 is located in the opening path of the movable bolt 121, the protruded pin member 1232 can effectively keep the movable bolt 121 in the locking state.

In particular, referring to FIGS. 5, 7 and 8, the safety pin 124 of the door locking system 12 includes a self-locking pin 1241 and a pin bracket 1242 which can fix the self-locking pin 1241 on an inner side of the mounting plate 14. A spring 1243 is provided in a compressed state between the self-locking pin 1241 and the pin bracket 1242, and the self-locking pin 1241 is provided thereon with a position-limiting pole 1244 for stopping the spring 1243. An end of the self-locking pin 1241 away from the position-limiting pole 1244 is hung on the tempered glass plate 122 via a retaining bracket 1245. If the tempered glass plate 122 is broken, the tempered glass plate 122 cannot support the retaining bracket 1245 anymore, and thus the retaining bracket 1245 cannot apply any traction force to the self-locking pin 1241. In this case, the self-locking pin 1241 can protrude out of the pin bracket under a restoring force of the spring 1243. The protruded self-locking pin 1241 can enter corresponding groove 12111 in the slidable plate 1211 and thus can effectively keep the movable bolt 121 in the locking state.

Referring to FIGS. 7 and 8, the safety pin 125 includes a self-locking pin 1251 and a pin bracket 1242 which can fix the self-locking pin 1251 on an inner side of the door 12. A spring 1253 is provided in a compressed state between the self-locking pin 1251 and the pin bracket 1242, and the self-locking pin 1251 is provided thereon with a position-limiting pole 1254 for stopping the spring 1253. The position-limiting pole 1254 is limited by a self-locking pin fixing plate 1255 fixedly provided at a back portion of a combination lock 126. The self-locking pin fixing plate 1255 is provided therein with a position-limiting pole hole 12551 corresponding to the self-locking pin. When the self-locking pin fixing plate 1255 moves towards the inner side of the coffer, the position-limiting pole 1254 can move out of the position-limiting pole hole 12551 in the self-locking pin fixing plate 1255, at this time, the self-locking pin 1251 can protrude out of the pin bracket 1242 under a restoring force of the spring 1253 and enter corresponding groove 12112 in the slidable plate 1211 to effectively to prevent the slidable plate 1211 from sliding.

Further, in order to further ensure the safety of the coffer, an edge of the self-locking pin fixing plate 1255 is formed into a bend edge 12552 which hooks on an edge of the tempered glass plate 122, such that the tempered glass plate may be broken when the self-locking pin fixing plate 1255 is moved illegally inwardly. Therefore, the safety pins 123, 124 and 125 can simultaneously play their roles.

It is to be noted that, only three preferable embodiments according to the present application are described above. Other equivalent variations and modifications without departing from the spirit of the present application should be deemed to fall into the protection scope of the present application.

What is claimed is:

1. A safe coffer comprising a coffer body, on at least one side of which a door is provided, the door being provided with a door locking system which includes a movable bolt which can keep the door and the coffer body in a locking state, characterized in that the door locking system further includes a breakable component which is fixedly provided on an inner side of the door and controls at least one safety pin, and the safety pin keeps the movable bolt in the locking state when the breakable component is broken; wherein the door locking system further includes a slidable plate which is connected with the movable bolt and is controlled to slide leftwards or rightwards by an operation component provided outside the coffer, leftward or rightward sliding of the slidable plate brings the movable bolt to lock or unlock the door and the coffer body, and the slidable plate is provided at a side thereof with a groove which corresponds to the safety pin when the movable bolt is in the locking state; wherein the door locking system further includes a combination lock, and two safety pin are provided, the a first safety pin includes a first self-locking pin, a first pin bracket which fixes the first self-locking pin on the inner side of the door, and a first elastic member, elasticity of which is towards a first groove, provided in a compressed state between the first self-locking pin and the first pin bracket, the first self-locking pin is provided thereon with a first position-limiting pole for stopping the first elastic member, and the first position-limiting pole is limited by a self-locking pin fixing plate fixedly provided at a back portion of the combination lock, the self-locking pin fixing plate is provided therein with a first position-limiting pole hole which corresponds to first self-locking pin, when the self-locking pin fixing plate is moved towards an inner side of the coffer, the first position-limiting pole moves out of the position-limiting pole hole in the self-locking pin fixing plate, and thus the self-locking pin enters the corresponding groove in the side of the slidable plate to keep the movable bolt in the locking state, wherein a second safety pin includes a second self-locking pin, a second pin bracket which fixes the second self-locking pin on the inner side of the door, and a second elastic member, elasticity of which is towards a second groove, provided in a compressed state between the second self-locking pin and the second pin bracket, the second self-locking pin is provided thereon with a second position-limiting pole for stopping the second elastic member, and an end of the second self-locking pin away from a second position-limiting pole is hung on the breakable component via a retaining bracket, when the breakable component is broken, the retaining bracket falls off from the breakable component, and thus the second self-locking pin enter the second groove in the side of the slidable plate to keep the movable bolt in the locking state.

2. The safe coffer according to claim 1, wherein at least one edge of the self-locking pin fixing plate is formed into a bend edge which is bent towards the breakable component and hooks on the breakable component.

3. The safe coffer according to claim 1, wherein the breakable component is a tempered glass plate fixedly provided on the inner side of the door.

4. The safe coffer according to claim 2, wherein the breakable component is a tempered glass plate fixedly provided on the inner side of the door.

5. A self-service terminal, characterized by comprising a safe coffer according to claim 1.

* * * * *